US012038183B2

(12) United States Patent
Mukaitani et al.

(10) Patent No.: US 12,038,183 B2
(45) Date of Patent: Jul. 16, 2024

(54) CHILLING UNIT AND CHILLING UNIT SYSTEM

(71) Applicant: Mitsubishi Electric Corporation, Tokyo (JP)

(72) Inventors: Naoya Mukaitani, Tokyo (JP); Shohei Takenaka, Tokyo (JP); Takahito Hikone, Tokyo (JP); Kimitaka Kadowaki, Tokyo (JP); Yoshio Yamano, Tokyo (JP); Takuya Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 307 days.

(21) Appl. No.: 17/619,283

(22) PCT Filed: Aug. 7, 2019

(86) PCT No.: PCT/JP2019/031082
§ 371 (c)(1),
(2) Date: Dec. 15, 2021

(87) PCT Pub. No.: WO2021/024405
PCT Pub. Date: Feb. 11, 2021

(65) Prior Publication Data
US 2022/0252281 A1 Aug. 11, 2022

(51) Int. Cl.
*F24F 1/16* (2011.01)
*F24F 1/50* (2011.01)

(52) U.S. Cl.
CPC . *F24F 1/16* (2013.01); *F24F 1/50* (2013.01)

(58) Field of Classification Search
CPC ..... F24F 1/16; F24F 1/50; F24F 1/46
(Continued)

(56) References Cited

U.S. PATENT DOCUMENTS

2012/0125033 A1* 5/2012 Tanno ..... F25B 30/02 165/181
2018/0080667 A1* 3/2018 Nishimoto ..... F24F 1/16

FOREIGN PATENT DOCUMENTS

EP 3 287 706 A1 2/2018
EP 3 447 394 A1 2/2019
(Continued)

OTHER PUBLICATIONS

Extended European Search Report dated Jul. 14, 2022 issued in corresponding European Patent Application No. 19940779.2.
(Continued)

*Primary Examiner* — Steve S Tanenbaum
(74) *Attorney, Agent, or Firm* — Posz Law Group, PLC

(57) ABSTRACT

A chilling unit includes a machine room unit to accommodate a compressor and a heat exchanger, and a plurality of air heat exchangers placed on top of the machine room unit. The air heat exchangers include a pair of air heat exchangers including two air heat exchangers opposite to each other in a lateral direction. They are inclined such that respective upper end portions of the two air heat exchangers have a spacing between each other greater than a spacing between respective lower end portions of the two air heat exchangers. In the lateral direction, the machine room unit has a top width greater than a heat-exchanger bottom width, the top width is one between side walls in a top face portion of the machine room unit, the bottom width is defined as a width between outer side faces of the respective lower end portions of the two air heat exchangers.

13 Claims, 13 Drawing Sheets

Comparative Example

(58) Field of Classification Search
USPC ..... 62/498
See application file for complete search history.

(56) References Cited

FOREIGN PATENT DOCUMENTS

| | | | | | |
|---|---|---|---|---|---|
| JP | H05-296643 | A | | 11/1993 | |
| JP | 5500725 | B2 | | 3/2014 | |
| WO | 2017/216926 | A1 | | 12/2017 | |
| WO | WO-2017216926 | A1 | * | 12/2017 | ..... F24F 1/14 |
| WO | 2018/070143 | A1 | | 4/2018 | |

OTHER PUBLICATIONS

Office Action dated Aug. 16, 2022 issued in corresponding JP Patent Application No. 2021-538609 (and English machine translation).
International Search Report dated Oct. 8, 2019, issued in corresponding International Application No. PCT/JP2019/031082 (and English Machine Translation).

* cited by examiner

Comparative Example

CHILLING UNIT AND CHILLING UNIT SYSTEM

CROSS REFERENCE TO RELATED APPLICATION

This application is a U.S. National Stage Application of International Application No. PCT/JP2019/031082, filed on Aug. 7, 2019, the contents of which are incorporated herein by reference.

TECHNICAL FIELD

The present disclosure relates to a chilling unit forming an apparatus such as an air-conditioning apparatus, a heat-pump water heating apparatus, or a refrigeration apparatus, and to a chilling unit system including a plurality of the chilling units.

BACKGROUND ART

Chilling units serving as heat-pump heat source units have been proposed in the related art. The chilling units have a housing that accommodates devices forming a heat pump, such as an air heat exchanger, an air-sending device, a compressor, and a heat exchanger (see, for example, Patent Literature 1). Such a chilling unit described in Patent Literature 1 is equipped with a housing including an upper housing and a lower housing. The upper housing accommodates an air heat exchanger and an air-sending device, and the lower housing accommodates a compressor and a heat exchanger. The upper housing is inclined such that in front view, its left and right side faces define a width therebetween that decreases as the upper housing extends downward. The lower housing is contiguous with the bottom face of the upper housing.

CITATION LIST

Patent Literature

Patent Literature 1: Japanese Patent No. 5500725

SUMMARY OF INVENTION

Technical Problem

The lower housing of the chilling unit described in Patent Literature 1 is in the form of a cuboid whose front and back faces are rectangular. The lower housing has a width in the lateral direction that is substantially equal to the lateral width of the bottom face of the upper housing. Since the lateral width of the lower housing is substantially equal to the lateral width of the bottom face of the upper housing, there is limited space available inside the housing. This limits freedom in, for example, the layout of devices forming a refrigerant circuit, such as a compressor, or the routing of pipes.

The present disclosure aims at addressing the above-mentioned problem. Accordingly, it is an object of the present disclosure to provide a chilling unit and a chilling unit system that have enough space available inside the housing to accommodate the compressor and other devices forming the refrigerant circuit, and consequently allow for increased freedom in, for example, the layout of devices forming the refrigerant circuit, or the routing of pipes.

Solution to Problem

A chilling unit according to an embodiment of the present disclosure includes a machine room unit formed in a shape of an elongated box and configured to accommodate a compressor and a heat exchanger, and a plurality of air heat exchangers placed on top of the machine room unit, the plurality of air heat exchangers forming a refrigerant circuit together with the compressor and the heat exchanger. The plurality of air heat exchangers include a pair of air heat exchangers, the pair of air heat exchangers including two air heat exchangers that are opposite to each other in a lateral direction of the machine room unit. The two air heat exchangers are inclined such that respective upper end portions of the two air heat exchangers remote from the machine room unit have a spacing between each other that is greater than a spacing between respective lower end portions of the two air heat exchangers proximate to the machine room unit. In the lateral direction, the machine room unit has a top width that is greater than a heat-exchanger bottom width, the top width being defined as a width between side walls in a top face portion of the machine room unit, the heat-exchanger bottom width being defined as a width between outer side faces of the respective lower end portions of the two air heat exchangers.

A chilling unit system according to an embodiment of the present disclosure is a chilling unit system including a plurality of the chilling units mentioned above. The plurality of chilling units include two adjacent chilling units, and in the lateral direction, the machine room units of the two adjacent chilling units have a spacing between each other of greater than or equal to 400 mm.

Advantageous Effects of Invention

According to an embodiment of the present disclosure, the machine room unit of the chilling unit has a top width that is greater than the heat-exchanger bottom width defined between a pair of air heat exchangers. In comparison to the chilling unit described in Patent Literature 1 in which the top width of the machine room unit, and the heat-exchanger bottom width defined between a pair of air heat exchangers are equal, the above-mentioned chilling unit has increased space available inside the machine room unit to accommodate the compressor and other devices forming the refrigerant circuit. As a result, in comparison to the chilling unit described in Patent Literature 1, the above-mentioned chilling unit allows for increased freedom in, for example, the layout of devices forming the refrigerant circuit, or the routing of pipes.

DESCRIPTION OF EMBODIMENTS

A chilling unit 100 and a chilling unit system 110 according to embodiments will be described below with reference to the drawings or other illustrations. In the figures below including FIG. 1, the relative dimensions, shapes, and other features of various components may differ from the actuality. In the figures below, the same reference signs are used to indicate the same or corresponding elements or features throughout the specification. Although terms representing directions (e.g., "upper", "lower", "right", "left", "front", or "back") are used as appropriate to facilitate understanding of the present disclosure, such terms are for illustrative purposes only and not intended to limit the corresponding apparatuses, devices, or components to any particular positioning or orientation.

Embodiment 1

[Chilling Unit 100]

Figure 1:
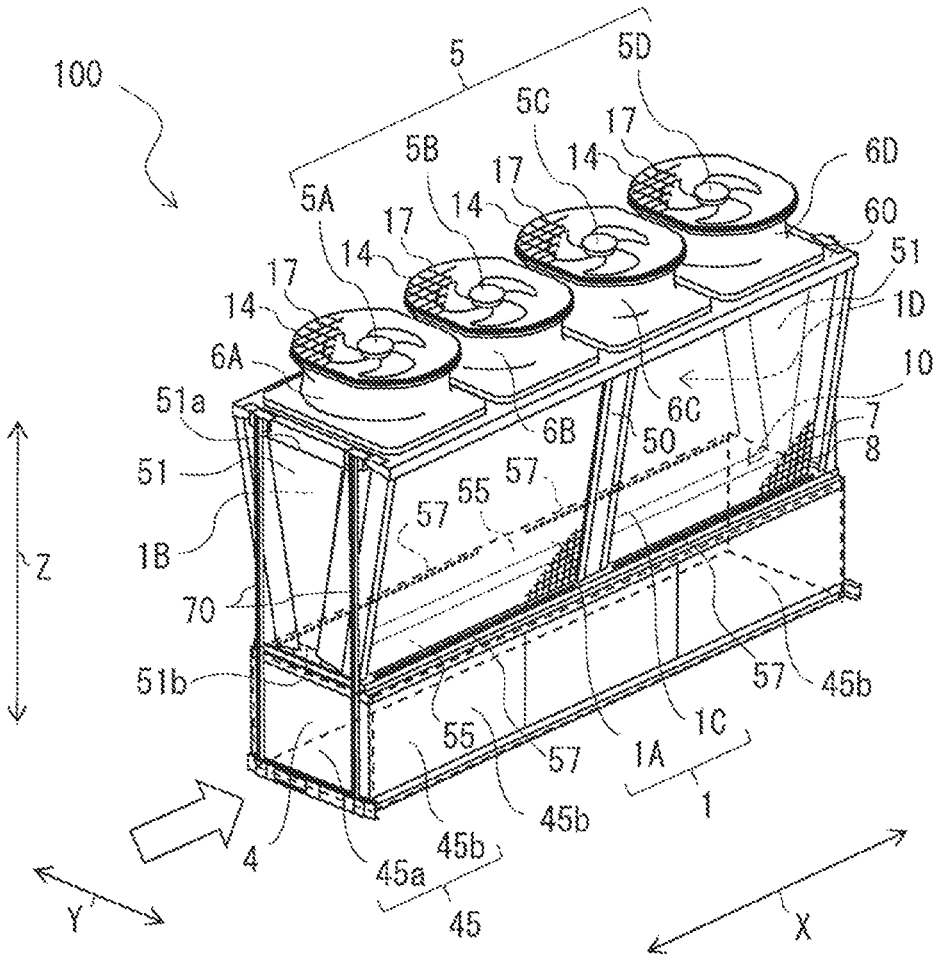
FIG. 1 is a perspective view of a chilling unit according to Embodiment 1.
Figure 2:
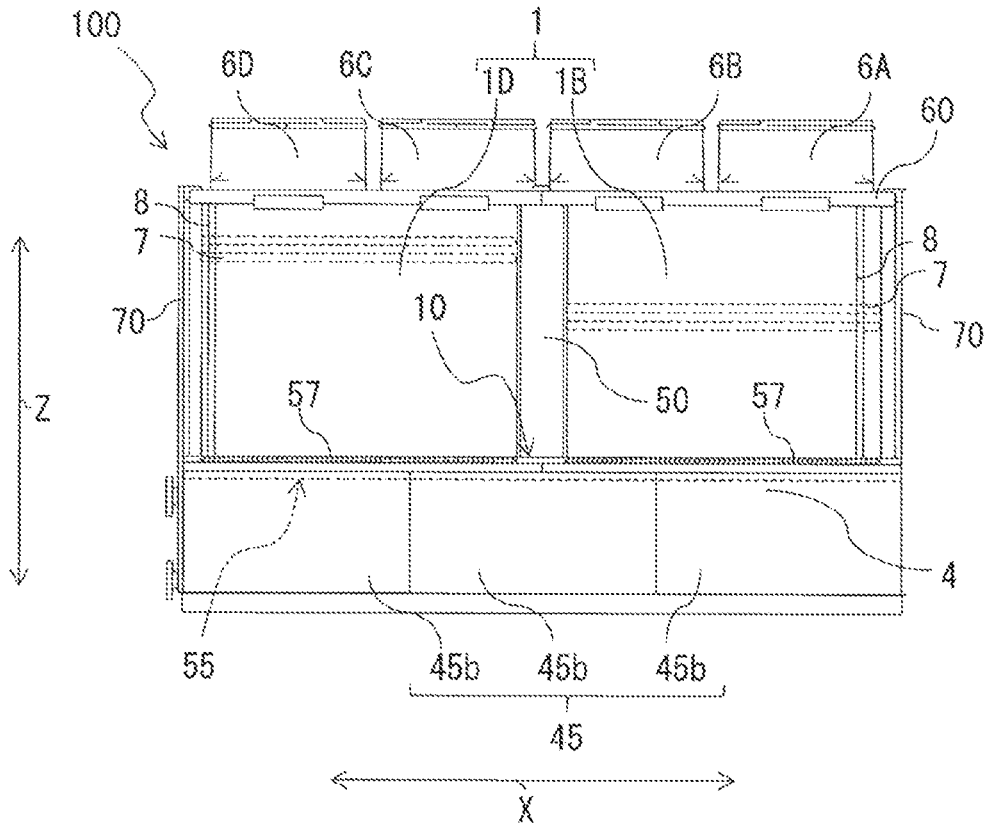
FIG. 2 is a side view of the chilling unit according to Embodiment 1.
Figure 3:
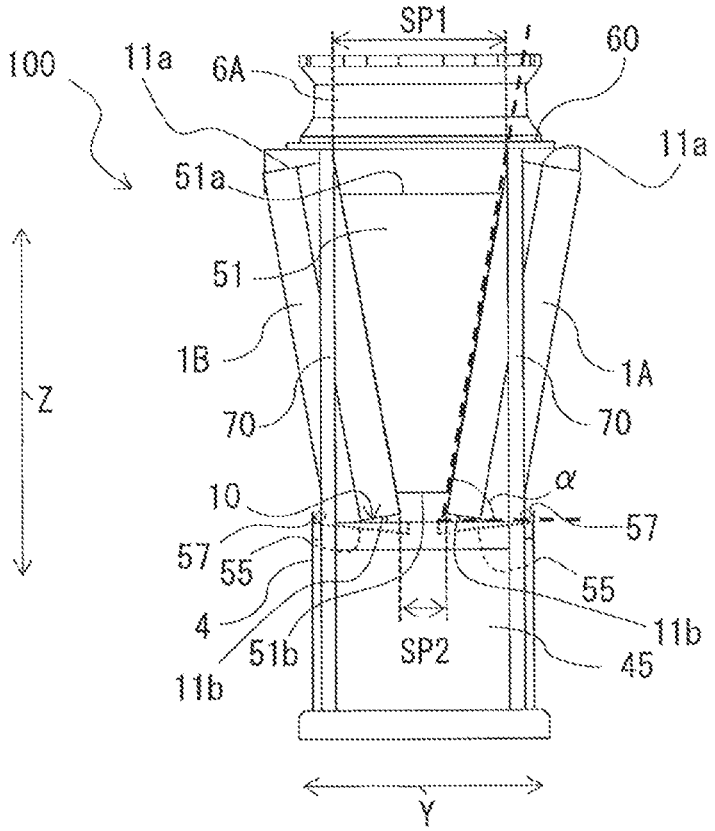
FIG. 3 is a front view of the chilling unit according to Embodiment 1.

FIG. 1 is a perspective view of the chilling unit 100 according to Embodiment 1. FIG. 2 is a side view of the chilling unit 100 according to Embodiment 1. FIG. 3 is a front view of the chilling unit 100 according to Embodiment 1. FIG. 3 is a front view of the chilling unit 100 as seen in the direction of an open arrow in FIG. 1. Reference is now made to FIGS. 1 to 3 to describe an overview of the chilling unit 100. In the figures below including FIG. 1, the X-axis represents the longitudinal direction of the chilling unit 100, the Y-axis represents the direction of width or lateral direction of the chilling unit 100, and the Z-axis represents the vertical direction of the chilling unit 100. The relative positions of individual components (e.g., their relative vertical positions) described herein basically correspond to those when the chilling unit 100 is installed in a usable condition.

The chilling unit 100 is used as a heat source device for a chiller apparatus. The chilling unit 100 receives a heat transfer fluid such as water or antifreeze supplied from a load-side unit (not illustrated). The heat transfer fluid is cooled or heated in the chilling unit 100 before being fed to the load-side unit. The chilling unit 100 allows the heat transfer fluid to circulate as described above to thereby supply cooling energy or heating energy to the load-side unit.

The chilling unit 100 has an elongated shape. The chilling unit 100 includes an air heat exchanger 1, which forms a heat-source-side refrigeration cycle, a fan 5, and a machine room unit 4.

(Air Heat Exchanger 1)

The air heat exchanger 1 is configured to exchange heat between refrigerant flowing inside the air heat exchanger 1 and outside air. The air heat exchanger 1 functions as an evaporator or a condenser. The air heat exchanger 1 includes a plurality of heat transfer tubes 7, and a plurality of fins 8. The air heat exchanger 1 is, for example, a parallel flow heat exchanger, and includes a pair of headers (not illustrated), the heat transfer tubes 7, and the fins 8. The heat transfer tubes 7 are, for example, aluminum flat tubes. The fins 8 are, for example, corrugated fins. The air heat exchanger 1 is not limited to a parallel flow heat exchanger. The air heat exchanger 1 may be, for example, a fin-and-tube heat exchanger having the fins 8 in the form of plates arranged in parallel to each other, with each heat transfer tube 7 penetrating the fins 8. The air heat exchanger 1 includes the following four air heat exchangers 1: an air heat exchanger 1A, an air heat exchanger 1B, an air heat exchanger 1C, and an air heat exchanger 1D. The air heat exchanger 1A corresponds to a first air heat exchanger, the air heat exchanger 1B corresponds to a second air heat exchanger, the air heat exchanger 1C corresponds to a third air heat exchanger, and the air heat exchanger 1D corresponds to a fourth air heat exchanger.

In the lateral direction (Y-axis direction) of the machine room unit 4, the air heat exchanger 1A and the air heat exchanger 1B are opposite to each other. The air heat exchanger 1A and the air heat exchanger 1B forming a pair of air heat exchangers 1 are inclined such that a top spacing SP1, which is the spacing between their respective upper end portions 11*a* remote from the machine room unit 4, is greater than a bottom spacing SP2, which is the spacing between their respective lower end portions 11*b* proximate to the machine room unit 4. That is, the air heat exchanger 1A and the air heat exchanger 1B are inclined such that when viewed from the front of the chilling unit 100, the two heat exchangers define a V-shape as illustrated in FIG. 3. In the lateral direction (Y-axis direction) of the machine room unit 4, the air heat exchanger 1C and the air heat exchanger 1D, which are opposite to each other, are likewise inclined such that the two heat exchangers define a V-shape. In Embodiment 1, the air heat exchanger 1A has an inclination angle $\alpha$ of, for example, 65 degrees to 80 degrees. As with the air heat exchanger 1A, the air heat exchanger 1B, the air heat exchanger 1C, and the air heat exchanger 1D are each disposed to have an inclination angle of 65 degrees to 80 degrees.

A top frame 60 is disposed above the air heat exchanger 1A, the air heat exchanger 1B, the air heat exchanger 1C, and the air heat exchanger 1D. The top frame 60 defines an upper wall of the chilling unit 100. The top frame 60 is secured to the machine room unit 4 by support posts 70. The support posts 70 are disposed in opposite end portions of the chilling unit 100 in the longitudinal direction (X-axis direction). Two support posts 70 are disposed in each end portion of the chilling unit 100 in the longitudinal direction (X-axis direction). The two support posts 70 are disposed to extend in the vertical direction, and spaced apart from each other in the lateral direction (Y-axis direction). The upper end portion of each support post 70 is secured to the top frame 60, and the lower end portion is secured to the machine room unit 4.

In the lateral direction (Y-axis direction) of the chilling unit 100, a side panel 50 is disposed on one side of the chilling unit 100 such that the side panel 50 covers the space between the air heat exchanger 1A and the air heat exchanger 1C. The side panel 50 is a plate-like panel formed in a substantially rectangular shape. The side panel 50 extends in the vertical direction (Z-axis direction) and the longitudinal direction (X-axis direction). The side panel 50 is disposed along the inclination of each air heat exchanger 1 described above. In the lateral direction (Y-axis direction) of the chilling unit 100, the side panel 50 is disposed also on the other side of the chilling unit 100 such that the side panel 50 covers the space between the air heat exchanger 1B and the air heat exchanger 1D.

In the longitudinal direction (X-axis direction) of the chilling unit 100, a side panel 51 is disposed on one side of the chilling unit 100 such that the side panel 51 covers the space between the air heat exchanger 1A and the air heat exchanger 1B. The side panel 51 is a plate-like panel formed in a substantially trapezoidal shape. The side panel 51 has an upper edge portion 51*a* that is longer than a lower edge portion 51*b*. The side panel 51 extends in the vertical direction (Z-axis direction) and the lateral direction (Y-axis direction). The side panel 51 is disposed such that in the longitudinal direction (X-axis direction) of the chilling unit 100, the side panel 51 partially covers the respective end portions of the air heat exchanger 1A and the air heat exchanger 1B. In the longitudinal direction (X-axis direction) of the chilling unit 100, the side panel 51 is disposed also on the other side of the chilling unit 100 such that the side panel 51 covers the space between the air heat exchanger 1C and the air heat exchanger 1D. The side panel 51 is disposed such that in the longitudinal direction (X-axis direction) of the chilling unit 100, the side panel 51 partially covers the respective end portions of the air heat exchanger 1C and the air heat exchanger 1D.

(Fan 5)

The top frame 60 is provided with the fan 5 mentioned above. The fan 5 creates a flow of air passing through each air heat exchanger 1 and discharged through an air outlet 14 of, for example, a bellmouth 6A described later. The fan 5 is an air-sending unit with an axial fan. The fan 5 generates a flow of air for performing efficient heat exchange in each air heat exchanger 1. The fan 5 includes the following four fans 5: a fan 5A, a fan 5B, a fan 5C, and a fan 5D.

The top frame 60 is provided with a bellmouth 6A, a bellmouth 6B, a bellmouth 6C, and a bellmouth 6D. The fan 5A, the fan 5B, the fan 5C, and the fan 5D are respectively disposed inside the bellmouth 6A, the bellmouth 6B, the bellmouth 6C, and the bellmouth 6D.

The air outlet 14 is provided in the upper end portion of each of the bellmouth 6A, the bellmouth 6B, the bellmouth 6C, and the bellmouth 6D. The chilling unit 100 is of a "top-flow type" with the blowing side of each fan 5 facing upward. A fan guard 17 is provided to the air outlet 14 of each of the bellmouth 6A, the bellmouth 6B, the bellmouth 6C, and the bellmouth 6D. Each of the fan 5A, the fan 5B, the fan 5C, and the fan 5D is covered by the fan guard 17.

Figure 4:
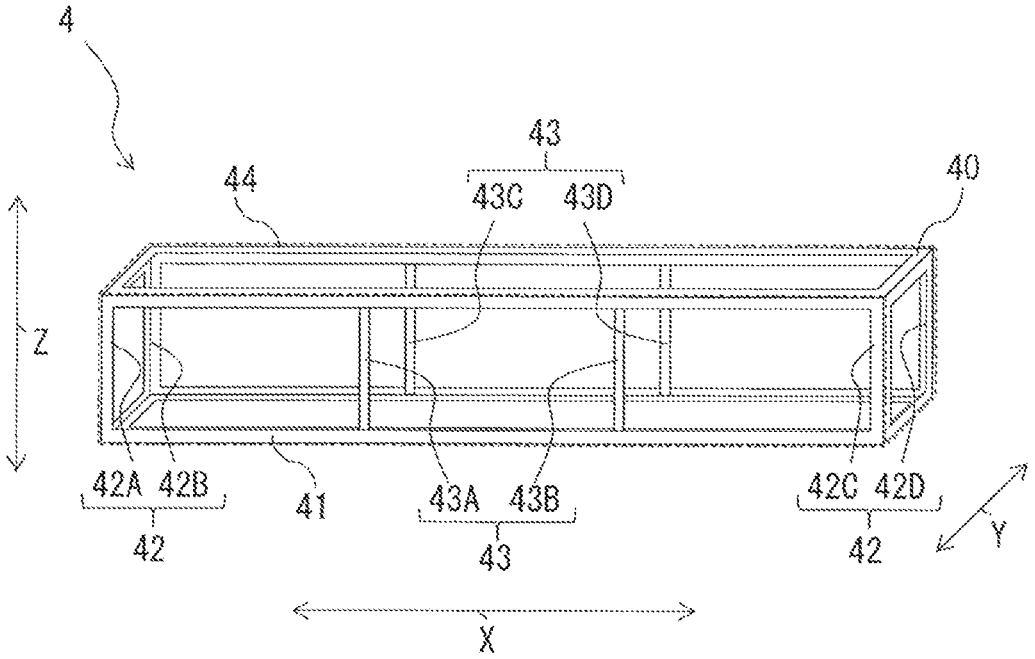
FIG. 4 is a schematic conceptual illustration of the structure of a machine room unit illustrated in FIG. 1.

FIG. 4 is a schematic conceptual illustration of the structure of the machine room unit 4 illustrated in FIG. 1. In FIGS. 1 and 4, the space occupied by the machine room unit 4 is represented by a dotted line. The structure of the machine room unit 4 is described below with reference to FIGS. 1 and 4. The machine room unit 4 has the shape of an elongated box, and is cuboid in form. The machine room unit 4 has a frame 40 that is cuboid in form, and a side wall 45 that covers the space between components forming the frame 40.

The frame 40 includes an underframe 41, a gatepost 42, an intermediate post 43, and a top beam 44. The gatepost 42 includes the following four gateposts 42: a gatepost 42A, a gatepost 42B, a gatepost 42C, and a gatepost 42D. The intermediate post 43 includes the following four intermediate posts 43: an intermediate post 43A, an intermediate post 43B, an intermediate post 43C, and an intermediate post 43D. The underframe 41 has a rectangular shape in plan view, and forms the bottom portion of the frame 40.

The gatepost 42A, the gatepost 42B, the gatepost 42C, and the gatepost 42D are disposed at the four corners of the underframe 41 so as to extend in the direction orthogonal to the underframe 41. The intermediate post 43A and the intermediate post 43B are respectively spaced apart from the gatepost 42A and the gatepost 42C in the longitudinal direction (X-axis direction) of the underframe 41. The intermediate post 43C and the intermediate post 43D are respectively spaced apart from the gatepost 42B and the gatepost 42D in the longitudinal direction (X-axis direction) of the underframe 41. The intermediate post 43A, the intermediate post 43B, the intermediate post 43C, and the intermediate post 43D extend in the direction orthogonal to the underframe 41. The top beam 44 is disposed above the gatepost 42A, the gatepost 42B, the gatepost 42C, and the gatepost 42D, as well as the intermediate post 43A, the intermediate post 43B, the intermediate post 43C, and the intermediate post 43D. The above-mentioned structure of the frame 40 is illustrative only. The frame 40 is not limited to the above-mentioned structure as long as the machine room unit 4 is cuboid in form.

A base 10 is provided to the top beam 44 of the machine room unit 4. The base 10 is supported by the gatepost 42 and the intermediate post 43. The air heat exchanger 1A, the air heat exchanger 1B, the air heat exchanger 1C, and the air heat exchanger 1D mentioned above are placed on the base 10. That is, the air heat exchangers 1 are placed on top of the machine room unit 4. A drain pan 55 is disposed on top of the machine room unit 4. The drain pan 55 catches droplets of water discharged from the air heat exchangers 1. The drain pan 55 is disposed below the air heat exchangers 1 to catch droplets of water dripping down from the air heat exchangers 1. The drain pan 55 extends in the longitudinal direction (X-axis direction) of the machine room unit 4. With the drain pan 55, the droplets of water naturally dripping down under gravity from the air heat exchangers 1 are collected as drain water and guided to a drain outlet (not illustrated).

The side wall 45 includes a first side wall 45*a* disposed in each end portion of the machine room unit 4 in the longitudinal direction (X-axis direction), and a second side wall 45*b* disposed in each end portion of the machine room unit 4 in the lateral direction (Y-axis direction). The first side wall 45*a* is a plate-like side wall that extends in the vertical direction (Z-axis direction) and the lateral direction (Y-axis direction). The first side wall 45*a* is disposed to cover the space defined between the gatepost 42A and the gatepost 42B. Further, the first side wall 45*a* is disposed to cover the space defined between the gatepost 42C and the gatepost 42D. The second side wall 45*b* is a plate-like side wall that extends in the vertical direction (Z-axis direction) and the longitudinal direction (X-axis direction). The second side wall 45*b* is disposed to cover each of the following spaces: the space defined between the gatepost 42A and the intermediate post 43A; the space defined between the intermediate post 43A and the intermediate post 43B; and the space defined between the intermediate post 43B and the gatepost 42C. Further, the second side wall 45*b* is disposed to cover each of the following spaces: the space defined between the gatepost 42B and the intermediate post 43C; the space defined between the intermediate post 43C and the intermediate post 43D; and the space defined between the intermediate post 43D and the gatepost 42D.

Figure 5:
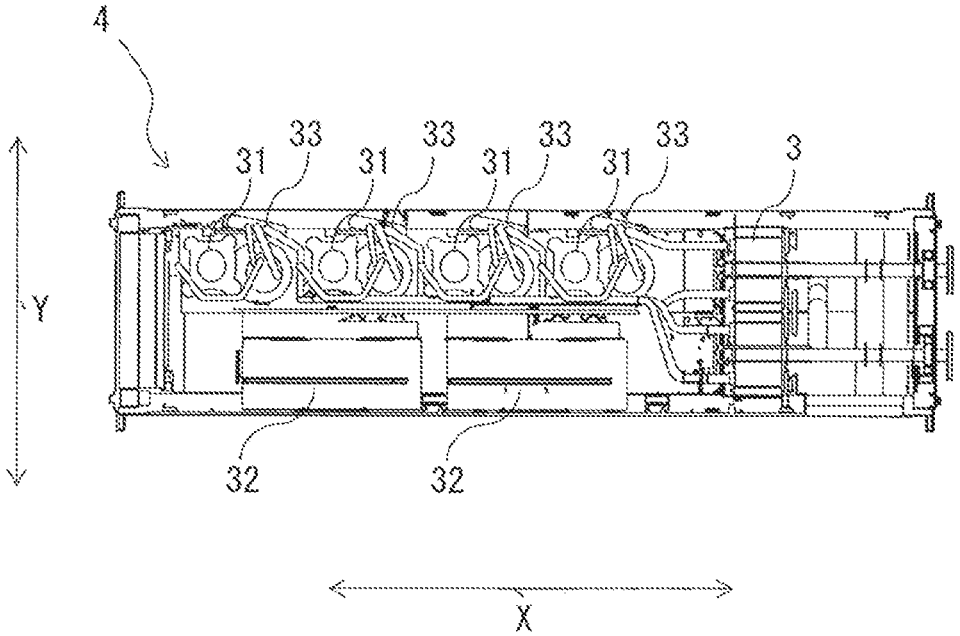
FIG. 5 is a plan view of the machine room unit illustrated in FIG. 1, schematically illustrating the internal structure of the machine room unit.

FIG. 5 is a plan view of the machine room unit 4 illustrated in FIG. 1, schematically illustrating the internal structure of the machine room unit 4. The machine room unit 4 accommodates a compressor 31, a flow switching device 33, a heat exchanger 3, and a pressure reducing device (not illustrated). The compressor 31, the flow switching device 33, the heat exchanger 3, the pressure reducing device, and the air heat exchangers 1 are connected in series by a refrigerant pipe to form a refrigerant circuit. The respective heat exchangers 3 of a plurality of chilling units 100 are connected in parallel by a water pipe, and a heat transfer fluid within the water pipe is caused by a pump unit (not illustrated) to pass through each heat exchanger 3 and circulate to a load-side unit (not illustrated). A plurality of devices installed in the machine room unit 4 include a control box 32. The control box 32 will be described later.

The compressor 31 sucks refrigerant in a low-temperature and low-pressure state, compresses the sucked refrigerant into a high-temperature and high-pressure state, and discharges the resulting refrigerant. The flow switching device 33 is, for example, a four-way valve, and configured to, while being controlled by a controller (not illustrated), switch the flows of refrigerant. The heat exchanger 3 causes heat to be exchanged between refrigerant and a heat transfer fluid such as water or antifreeze. The pressure reducing device is, for example, an expansion valve, and reduces the pressure of refrigerant. The control box 32 accommodates, for example, a control board for controlling the flow switching device 33, a control board for controlling the opening degree of the pressure reducing device or other conditions, an inverter board for controlling the rotation speed of the compressor 31 or other conditions.

The machine room unit 4 may include a heater 57. Operating the chilling unit 100 in cold climates often brings about the problem of how to handle ice that remains on the drain pan 55. Due to the presence of the heater 57 in the chilling unit 100, in operating the chilling unit 100 in cold climates, the heater 57 can be used to melt ice forming on the drain pan 55, or to prevent icing of drain water. If the machine room unit 4 includes the heater 57, the heater 57 is disposed near each air heat exchanger 1. For example, the heater 57 is disposed above the drain pan 55 such that the heater 57 extends along the lower end portion 11*b* of each air heat exchanger 1 in the longitudinal direction (X-axis direction) of the machine room unit 4.

[Operation of Chilling Unit 100]

In the chilling unit 100, outside air is directed by the fans 5 to pass through the air heat exchangers 1. Heat is thus exchanged between the air and refrigerant flowing inside each air heat exchanger 1, and the air that has exchanged heat with the refrigerant is discharged from the top of the chilling unit 100. The chilling unit 100 can be switched through the switching action of the flow switching device 33 between the following operations: a cooling operation in which each air heat exchanger 1 functions as a condenser and the heat exchanger 3 functions as an evaporator; and a heating operation in which each air heat exchanger 1 functions as an evaporator and the heat exchanger 3 functions as a condenser. In the cooling operation, a cooled heat transfer fluid is generated in the heat exchanger 3 and, for example, the cooled heat transfer fluid is supplied to the load-side unit (not illustrated) to cool the load-side (indoor-side) air to thereby provide cooling to the indoor space. In heating operation, a heated heat transfer fluid is generated in the heat exchanger 3 and, for example, the heated heat transfer fluid is supplied to the load-side unit (not illustrated) to heat the load-side (indoor-side) air to thereby provide heating to the indoor space.

[Relationship Between Air Heat Exchangers 1 and Machine Room Unit 4]

Figure 6:
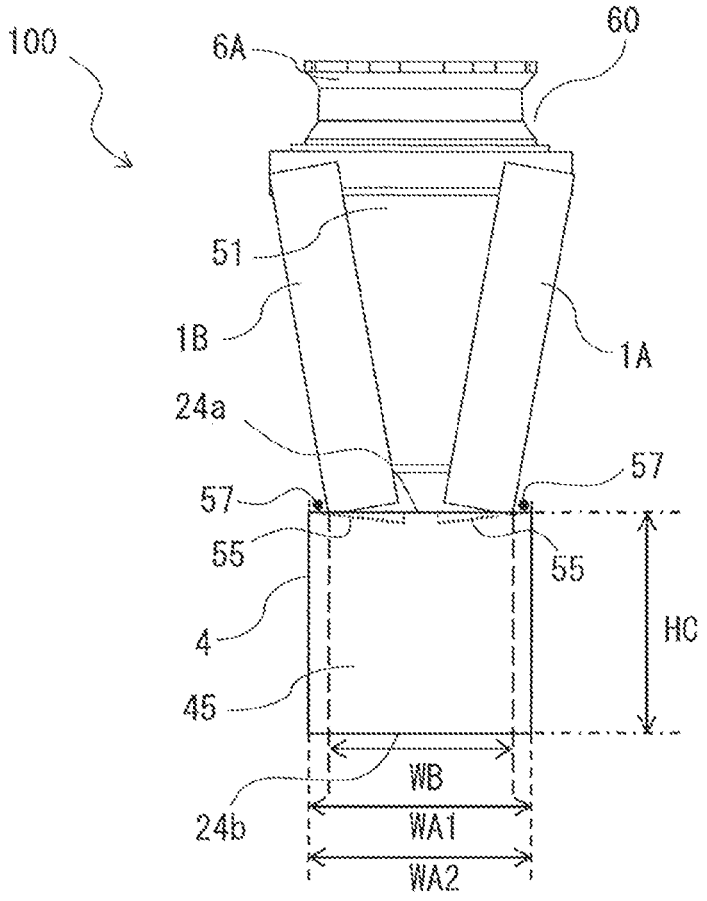
FIG. 6 conceptually illustrates the relationship between air heat exchangers and the machine room unit that form the chilling unit according to Embodiment 1.

FIG. 6 conceptually illustrates the relationship between the air heat exchangers 1 and the machine room unit 4 that form the chilling unit 100 according to Embodiment 1. FIG. 6 does not depict some of components such as the support posts 70 for ease of illustration of the relationship between the air heat exchangers 1 and the machine room unit 4. Now, in the lateral direction (Y-axis direction) of the chilling unit 100, the width between side walls in a top face portion 24*a* of the machine room unit 4 is defined as a top width WA1. The width between the outer side faces of the respective lower end portions 11*b* of the air heat exchanger 1A and the air heat exchanger 1B that form a pair of air heat exchangers 1 is defined as a heat-exchanger bottom width WB. As described above, in the lateral direction (Y-axis direction) of the machine room unit 4, the air heat exchanger 1A and the air heat exchanger 1B are opposite to each other. As illustrated in FIG. 6, in the chilling unit 100, the top width WA1 is greater than the heat-exchanger bottom width WB. That is, the chilling unit 100 is formed such that top width WA1>heat-exchanger bottom width WB.

The chilling unit 100 is formed such that the top width WA1 and the heat-exchanger bottom width WB have a difference of less than or equal to 50 mm. That is, the chilling unit 100 is formed such that 0 mm<top width WA1−heat-exchanger bottom width WB≤50 mm.

Further, in the lateral direction (Y-axis direction) of the machine room unit 4, the width between side walls in a bottom face portion 24*b* of the machine room unit 4 is defined as a bottom width WA2. In the vertical direction (Z-axis direction) perpendicular to the longitudinal direction (X-axis direction) and the lateral direction (Y-axis direction) of the machine room unit 4, the dimension between the top face portion 24*a* and the bottom face portion 24*b* of the machine room unit 4 is defined as a height dimension HC. In this case, the top width WA1, the bottom width WA2, and the height dimension HC of the machine room unit 4 are equal. In other words, in the machine room unit 4 of the chilling unit 100, the top width WA1 and the bottom width WA2 are equal, and the top width WA1 and the bottom width WA2, and the height dimension HC are equal. That is, the chilling unit 100 is formed such that (top width WA1=bottom width WA2)=height dimension HC.

[Operational Effects of Chilling Unit 100]

The machine room unit 4 of the chilling unit 100 has the top width WA1 that is greater than the heat-exchanger bottom width WB defined between a pair of air heat exchangers 1. In comparison to a case where the top width WA1 of the machine room unit 4 and the heat-exchanger bottom width WB defined between a pair of air heat exchangers 1 are equal, the chilling unit 100 configured as described above allows for enough space available inside the machine room unit 4 to accommodate the compressor 31 and other devices forming the refrigerant circuit. Consequently, in comparison to a case where the top width WA1 of the machine room unit 4 and the heat-exchanger bottom width WB defined between a pair of air heat exchangers 1 are equal, the chilling unit 100 allows for increased freedom in, for example, the layout of devices forming the refrigerant circuit, or the routing of pipes.

Figure 7:
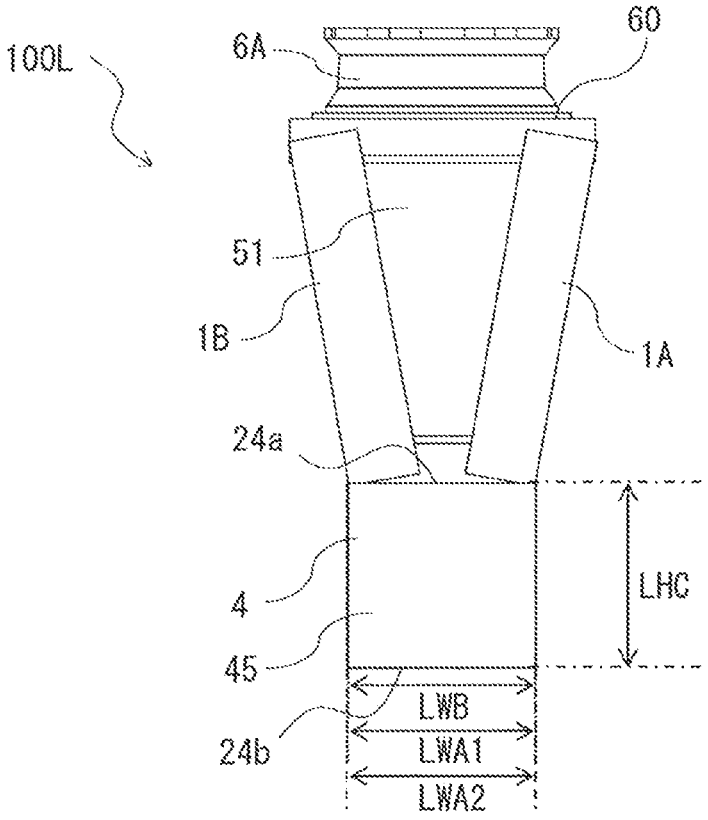
FIG. 7 is a front view of a chilling unit according to a comparative example.

FIG. 7 is a front view of a chilling unit 100L according to a comparative example. In the lateral direction (Y-axis direction) of the chilling unit 100L, the width between side walls in the top face portion 24*a* of the machine room unit 4 is defined as a top width LWA1. The width between the outer side faces of the respective lower end portions 11*b* of the air heat exchanger 1A and the air heat exchanger 1B that form a pair of air heat exchangers 1 is defined as a heat-exchanger bottom width LWB. In the lateral direction (Y-axis direction) of the machine room unit 4, the width between side walls in the bottom face portion 24*b* of the machine room unit 4 is defined as a bottom width LWA2. Further, in the vertical direction (Z-axis direction) of the machine room unit 4, the dimension between the top face portion 24*a* and the bottom face portion 24*b* of the machine room unit 4 is defined as a height dimension LHC. The chilling unit 100L according to the comparative example corresponds to the chilling unit 100L in the related art, in which the top width LWA1 of the machine room unit 4, and the heat-exchanger bottom width LWB defined between a pair of air heat exchangers 1 are equal. As described above, in the chilling unit 100L according to the comparative example, the top width LWA1 of the machine room unit 4, and the heat-exchanger bottom width LWB defined between a pair of air heat exchangers 1 are equal. Consequently, the chilling unit 100L does not have much space available inside the machine room unit 4. As a result, the chilling unit 100L according to the comparative example allows for limited freedom in, for example, the layout of the compressor 31 and other devices forming the refrigerant circuit, or the routing of pipes.

By contrast, the machine room unit 4 of the chilling unit 100 according to Embodiment 1 has a width in the lateral direction (Y-axis direction) that is greater than the width in the lateral direction (Y-axis direction) of the machine room unit 4 of the chilling unit 100L according to the comparative example. Consequently, the chilling unit 100 according to Embodiment 1 has more space available inside the machine room unit 4 to accommodate the compressor 31 and other devices forming the refrigerant circuit than does the chilling unit 100L according to the comparative example. As a result, the chilling unit 100 according to Embodiment 1 allows for greater freedom in, for example, the layout of devices forming the refrigerant circuit, or the routing of pipes than does the chilling unit 100L according to the comparative example. Further, as described above, the chilling unit 100 according to Embodiment 1 has more space available inside the machine room unit 4 than does the chilling unit 100L according to the comparative example. The chilling unit 100 thus allows for greater ease of maintenance by the operator than does the chilling unit 100L according to the comparative example.

In the chilling unit 100, the top width WA1 and the heat-exchanger bottom width WB have a difference of less than or equal to 50 mm. The difference of less than or equal to 50 mm between the top width WA1 and the heat-exchanger bottom width WB in the chilling unit 100 helps to ensure that there is enough space for the operator to work on the chilling unit 100 from the side. Therefore, the chilling unit 100 allows for increased ease of maintenance on the chilling unit 100 by the operator, in comparison to a case where the difference between the top width WA1 and the heat-exchanger bottom width WB is greater than or equal to 50 mm.

The top width WA1, the bottom width WA2, and the height dimension HC of the machine room unit 4 are equal. The chilling unit 100 according to Embodiment 1 has more space available inside the machine room unit 4 to accommodate the compressor 31 and other devices forming the refrigerant circuit than does the chilling unit 100L according to the comparative example in which the top width LWA1 and the heat-exchanger bottom width LWB are equal. As a result, the chilling unit 100 according to Embodiment 1 allows for greater freedom in, for example, the layout of devices forming the refrigerant circuit, or the routing of pipes than does the chilling unit 100L according to the comparative example. Further, as described above, the chilling unit 100 according to Embodiment 1 has more space available inside the machine room unit 4 than does the chilling unit 100L according to the comparative example. The chilling unit 100 thus allows for greater ease of maintenance by the operator than does the chilling unit 100L according to the comparative example.

The chilling unit 100 includes the drain pan 55 disposed below the air heat exchangers 1 to catch droplets of water dripping down from the air heat exchangers 1, and the heater 57 provided to the drain pan 55 and extending along the lower end portions 11*b* of the air heat exchangers 1. In the chilling unit 100 according to the comparative example, the top width WA1 of the machine room unit 4, and the heat-exchanger bottom width WB defined between a pair of air heat exchangers 1 are equal. Consequently, the chilling unit 100 according to the comparative example does not allow the drain pan 55 to have enough area to install the heater 57. By contrast, the machine room unit 4 of the chilling unit 100 according to Embodiment 1 has a width in the lateral direction (Y-axis direction) that is greater than the width in the lateral direction (Y-axis direction) of the machine room unit 4 of the chilling unit 100L according to the comparative example. The chilling unit 100 according to Embodiment 1 thus allows the drain pan 55 to have enough area to install the heater 57.

Embodiment 2

[Configuration of Chilling Unit 100A]

Figure 8:
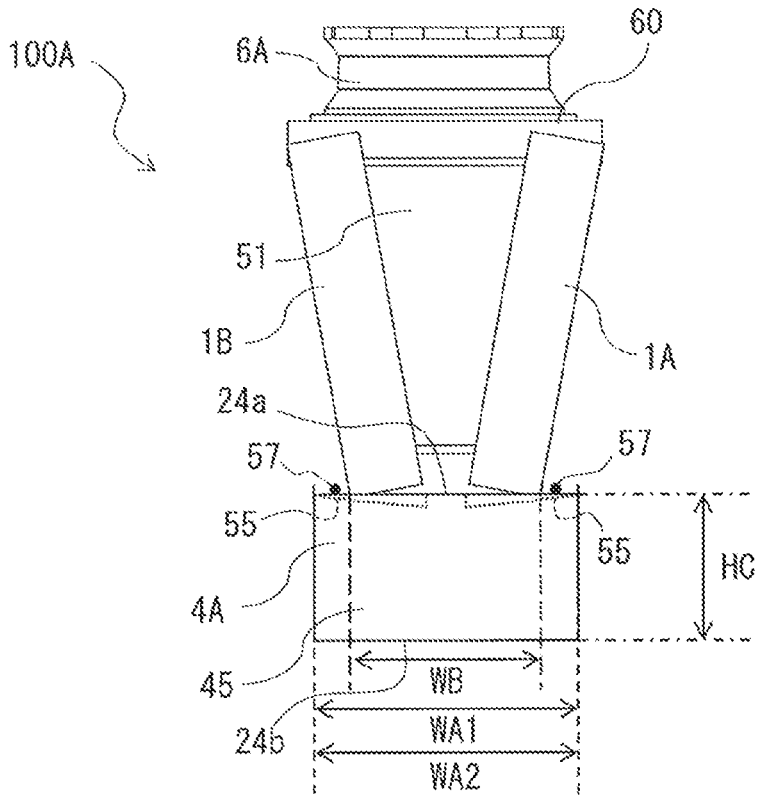
FIG. 8 is a front view of a chilling unit according to Embodiment 2.

FIG. 8 is a front view of a chilling unit 100A according to Embodiment 2. Features configured in the same manner as those of the chilling unit 100 in FIGS. 1 to 6 are designated by the same reference signs and not described in further detail below. The chilling unit 100A according to Embodiment 2 includes a machine room unit 4A that differs in structure from the machine room unit 4 of the chilling unit 100 according to Embodiment 1. The following description of the machine room unit 4A mainly focuses on differences from the machine room unit 4, and features other than such differences are neither illustrated nor described in further detail.

In the machine room unit 4A, the top width WA1 and the bottom width WA2 are equal. In the machine room unit 4A, the top width WA1 and the bottom width WA2 are greater than the height dimension HC. That is, the chilling unit 100A is formed such that (top width WA1=bottom width WA2)>height dimension HC.

[Operational Effects of Chilling Unit 100A]

In the machine room unit 4A, the top width WA1 and the bottom width WA2 are equal, and the top width WA1 and the bottom width WA2 are greater than the height dimension HC. The chilling unit 100A according to Embodiment 2 has more space available inside the machine room unit 4 to accommodate the compressor 31 and other devices forming the refrigerant circuit than does the chilling unit 100L according to the comparative example in which the top width LWA1 and the heat-exchanger bottom width LWB are equal. As a result, the chilling unit 100A according to Embodiment 2 allows for greater freedom in, for example, the layout of devices forming the refrigerant circuit, or the routing of pipes than does the chilling unit 100L according to the comparative example. As described above, the chilling unit 100A according to Embodiment 2 has more space available inside the machine room unit 4 than does the chilling unit 100L according to the comparative example. The chilling unit 100A thus allows for greater ease of maintenance by the operator than does the chilling unit 100L according to the comparative example. Further, the chilling unit 100A according to Embodiment 2 thus allows the drain pan 55 to have enough area to install the heater 57.

In the machine room unit 4A, the top width WA1 and the bottom width WA2 are equal, and the top width WA1 and the bottom width WA2 are greater than the height dimension HC. Thus, the chilling unit 100A according to Embodiment 2 has a greater width in the lateral direction (Y-axis direction) than does the chilling unit 100 according to Embodiment 1. As a result, the chilling unit 100A according to Embodiment 2 allows for greater freedom in, for example, the layout of devices forming the refrigerant circuit, or the routing of pipes than does the chilling unit 100 according to Embodiment 1. As described above, the chilling unit 100A according to Embodiment 2 has more space available inside the machine room unit 4 than does the chilling unit 100 according to Embodiment 1. The chilling unit 100A thus allows for greater ease of maintenance by the operator than does the chilling unit 100 according to Embodiment 1. The chilling unit 100A according to Embodiment 2 also allows for greater stability in installation than does the chilling unit 100 according to Embodiment 1. Further, as described above, the chilling unit 100A according to Embodiment 2 has a greater width in the lateral direction (Y-axis direction) than does the chilling unit 100 according to Embodiment 1. This allows for increased freedom in how to install the heater 57.

Embodiment 3

[Configuration of Chilling Unit 100B]

Figure 9:
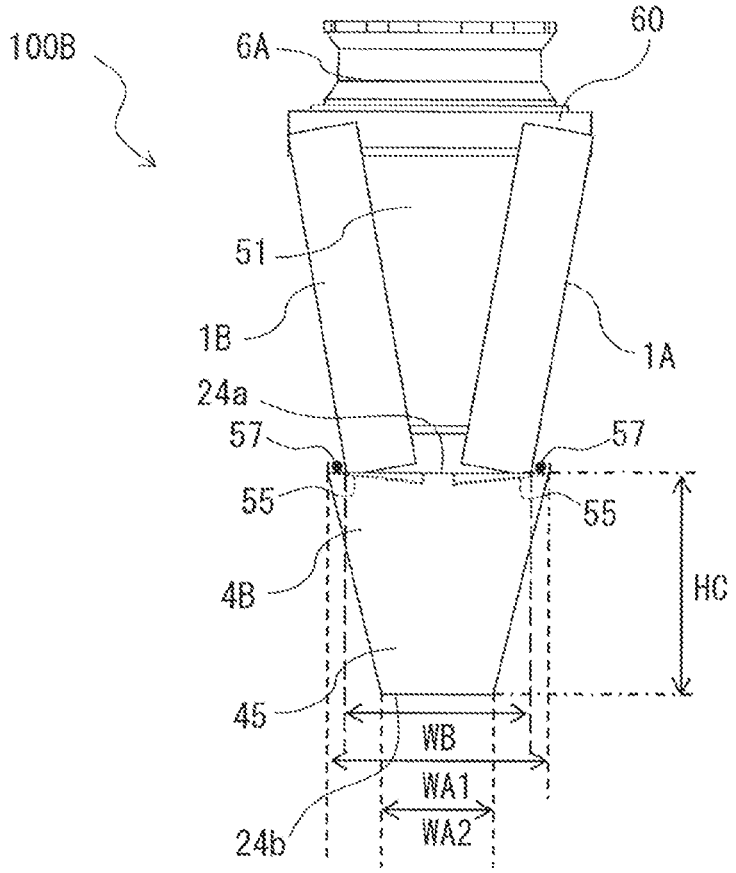
FIG. 9 is a front view of a chilling unit according to Embodiment 3.
Figure 10:
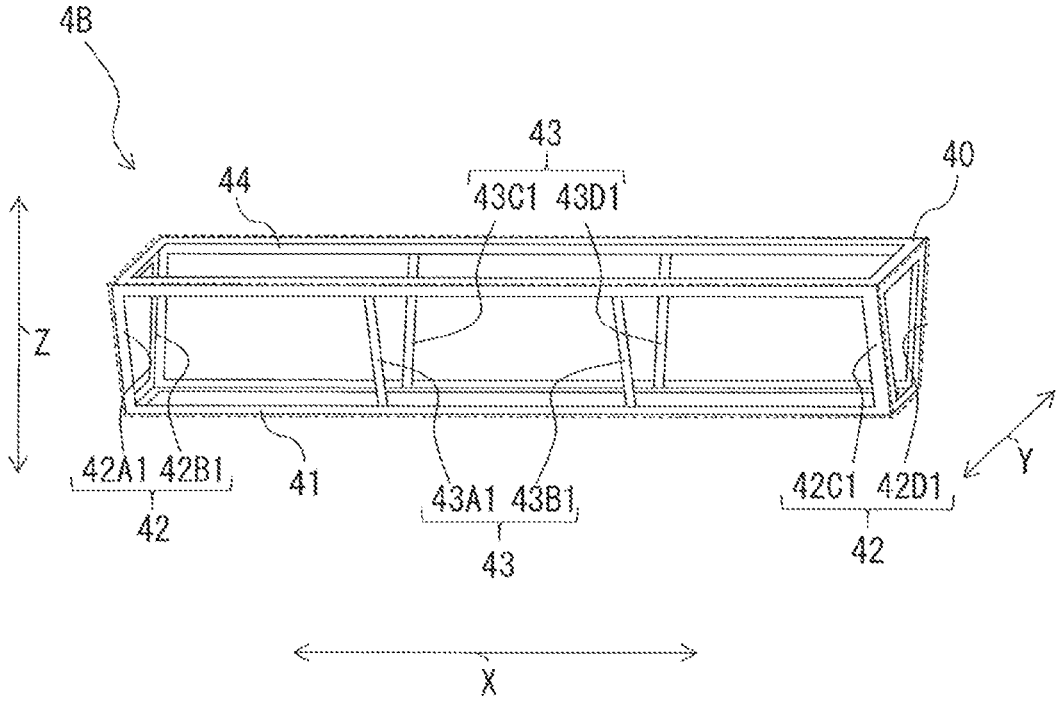
FIG. 10 is a schematic conceptual illustration of the structure of a machine room unit illustrated in FIG. 9.

FIG. 9 is a front view of a chilling unit 100B according to Embodiment 3. FIG. 10 is a schematic conceptual illustration of the structure of a machine room unit 4B illustrated in FIG. 9. In FIG. 10, the space occupied by the machine room unit 4B is represented by a dotted line. The structure of the machine room unit 4 is described below with reference to FIGS. 9 and 10. Features configured in the same manner as those of the chilling unit 100 in FIGS. 1 to 6 are designated by the same reference signs and not described in further detail below. The chilling unit 100B according to Embodiment 3 includes the machine room unit 4B that differs in structure from the machine room unit 4 of the chilling unit 100 according to Embodiment 1. The following description of the machine room unit 4B mainly focuses on differences from the machine room unit 4, and features other than such differences are neither illustrated nor described in further detail.

The machine room unit 4B has the shape of an elongated box, and is in the form of a quadrangular prism. The machine room unit 4B has a trapezoidal shape in cross-section taken perpendicular to the longitudinal direction (X-axis direction). The machine room unit 4B has the frame 40 in the form of a quadrangular prism, and the side wall 45 that covers the space between adjacent frames 40.

The frame 40 includes the underframe 41, the gatepost 42, the intermediate post 43, and the top beam 44. The gatepost 42 includes the following four gateposts 42: a gatepost 42A1, a gatepost 42B1, a gatepost 42C1, and a gatepost 42D1. The intermediate post 43 includes the following four intermediate posts 43: an intermediate post 43A1, an intermediate post 43B1, an intermediate post 43C1, and an intermediate post 43D1. The underframe 41 has a rectangular shape in plan view, and constitutes the bottom portion of the frame 40.

The gatepost 42A1, the gatepost 42B1, the gatepost 42C1, and the gatepost 42D1 are disposed at the four corners of the underframe 41 so as to extend at an inclination with respect to the direction orthogonal to the underframe 41. The gatepost 42A1, the gatepost 42B1, the gatepost 42C1, and the gatepost 42D1 are disposed such that in the lateral direction (Y-axis direction), each of these gateposts is inclined outward as the gatepost extends from the lower end portion toward the upper end portion. That is, in the lateral direction (Y-axis direction) of the machine room unit 4B, the gatepost 42A1 and the gatepost 42B1 are disposed at an inclination such that their respective upper end portions located near the top face portion 24*a* have a spacing between each other that is greater than the spacing between their respective lower end portions located near the bottom face portion 24*b*. Likewise, in the lateral direction (Y-axis direction) of the machine room unit 4B, the gatepost 42C1 and the gatepost 42D1 are disposed at an inclination such that their respective upper end portions located near the top face portion 24*a* have a spacing between each other that is greater than the spacing between their respective lower end portions located near the bottom face portion 24*b*.

The intermediate post 43A1 and the intermediate post 43B1 are respectively spaced apart from the gatepost 42A1 and the gatepost 42C1 in the longitudinal direction (X-axis direction) of the underframe 41. The intermediate post 43C1 and the intermediate post 43D1 are respectively spaced apart from the gatepost 42B1 and the gatepost 42D1 in the longitudinal direction (X-axis direction) of the underframe 41.

The intermediate post 43A1, the intermediate post 43B1, the intermediate post 43C1, and the intermediate post 43D1 are each disposed to extend at an inclination relative to the direction orthogonal to the underframe 41. The intermediate post 43A1, the intermediate post 43B1, the intermediate post 43C1, and the intermediate post 43D1 are disposed such that in the lateral direction (Y-axis direction), each of these intermediate posts is inclined outward as the intermediate post extends from the lower end portion toward the upper end portion. That is, in the lateral direction (Y-axis direction) of the machine room unit 4B, the intermediate post 43A1 and the intermediate post 43C1 are disposed at an inclination such that their respective upper end portions located near the top face portion 24*a* have a spacing between each other that is greater than the spacing between their respective lower end portions located near the bottom face portion 24*b*. Likewise, in the lateral direction (Y-axis direction) of the machine room unit 4B, the intermediate post 43B1 and the intermediate post 43D1 are disposed at an inclination such that their respective upper end portions located near the top face portion 24*a* have a spacing between each other that is greater than the spacing between their respective lower end portions located near the bottom face portion 24*b*.

The machine room unit 4B has a trapezoidal shape in cross-section taken perpendicular to the longitudinal direction (X-axis direction). The top width WA1 of the machine room unit 4B is greater than the bottom width WA2, and the top width WA1 and the height dimension HC of the machine room unit 4B are equal. That is, the chilling unit 100B is formed such that (top width WA1=height dimension HC)>bottom width WA2.

[Operational Effects of Chilling Unit 100B]

The machine room unit 4B has a trapezoidal shape in cross-section taken perpendicular to the longitudinal direction (X-axis direction). The top width WA1 of the machine room unit 4B is greater than the bottom width WA2, and the top width WA1 and the height dimension HC of the machine room unit 4B are equal. The chilling unit 100B according to Embodiment 3 has more space available inside the machine room unit 4B to accommodate the compressor 31 and other devices forming the refrigerant circuit than does the chilling unit 100L according to the comparative example in which the top width LWA1 and the heat-exchanger bottom width LWB are equal. As a result, the chilling unit 100B according to Embodiment 3 allows for greater freedom in, for example, the layout of devices forming the refrigerant circuit, or the routing of pipes than does the chilling unit 100L according to the comparative example. As described above, the chilling unit 100B according to Embodiment 3 has more space available inside the machine room unit 4B than does the chilling unit 100L according to the comparative example. The chilling unit 100B thus allows for greater ease of maintenance by the operator than does the chilling unit 100L according to the comparative example. Further, the chilling unit 100B according to Embodiment 3 thus allows the drain pan 55 to have enough area to install the heater 57.

The machine room unit 4B has a trapezoidal shape in cross-section taken perpendicular to the longitudinal direction (X-axis direction). The top width WA1 of the machine room unit 4B is greater than the bottom width WA2, and the top width WA1 and the height dimension HC of the machine room unit 4B are equal. The chilling unit 100B according to Embodiment 3 thus allows for more space at the operator's feet than does the chilling unit 100 according to Embodiment 1. Since the chilling unit 100B according to Embodiment 3 allows for enough space at the operator's feet, it is possible for the operator to, for example, remove a screw attached to a panel to thereby remove the panel, and place a screw box at the feet to store the removed screw. As a result, the chilling unit 100B according to Embodiment 3 allows for greater freedom in, for example, the layout of devices forming the refrigerant circuit, or the routing of pipes, and also greater ease of maintenance by the operator than does the chilling unit 100L.

Embodiment 4

[Configuration of Chilling Unit 100C]

Figure 11:
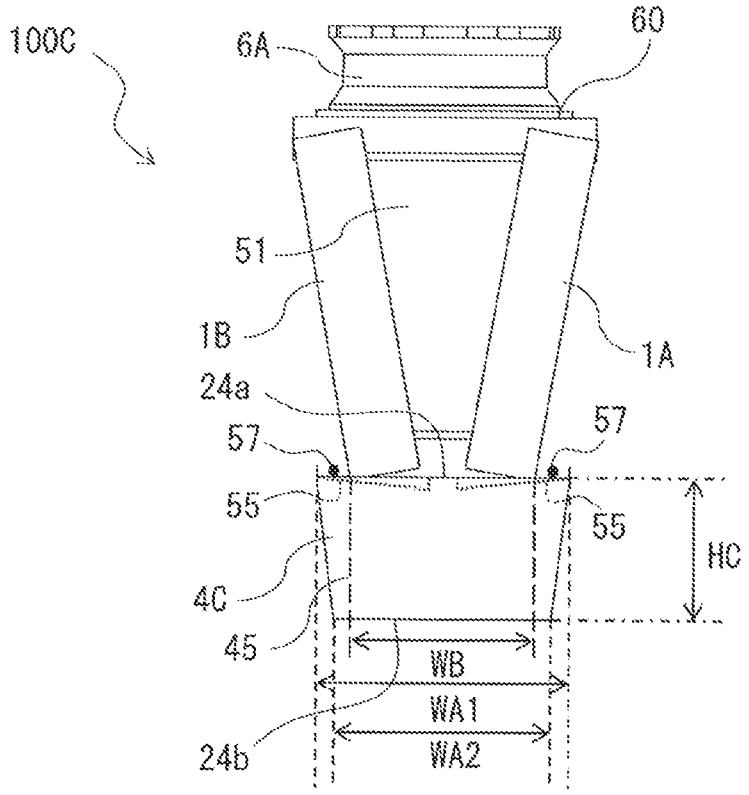
FIG. 11 is a front view of a chilling unit according to Embodiment 4.

FIG. 11 is a front view of a chilling unit 100C according to Embodiment 4. Features configured in the same manner as those of the chilling unit 100 in FIGS. 1 to 6 are designated by the same reference signs and not described in further detail below. The chilling unit 100C according to Embodiment 4 includes a machine room unit 4C that differs in structure from the machine room unit 4 of the chilling unit 100 according to Embodiment 1. The following description of the machine room unit 4C mainly focuses on differences from the machine room unit 4, and features other than such differences are neither illustrated nor described in further detail.

The machine room unit 4C has the shape of an elongated box, and is in the form of a quadrangular prism. The machine room unit 4C has a trapezoidal shape in cross-section taken perpendicular to the longitudinal direction (X-axis direction). The machine room unit 4C has the frame 40 in the form of a quadrangular prism, and the side wall 45 that covers the space between adjacent frames 40. The frame 40 of the machine room unit 4C has the same basic structure as that of the machine room unit 4B according to Embodiment 3.

The machine room unit 4C has a trapezoidal shape in cross-section taken perpendicular to the longitudinal direction (X-axis direction). The top width WA1 of the machine room unit 4C is greater than the bottom width WA2, and the top width WA1 of the machine room unit 4C is greater than the height dimension HC. That is, the chilling unit 1000 is formed such that top width WA1>bottom width WA2, and top width WA1>height dimension HC.

[Operational Effects of Chilling Unit 1000]

The machine room unit 4C has a trapezoidal shape in cross-section taken perpendicular to the longitudinal direction (X-axis direction). The top width WA1 of the machine room unit 4C is greater than the bottom width WA2, and the top width WA1 of the machine room unit 4C is greater than the height dimension HC. The chilling unit 100C according to Embodiment 4 has more space available inside the machine room unit 4 to accommodate the compressor 31 and other devices forming the refrigerant circuit than does the chilling unit 100L according to the comparative example in which the top width LWA1 and the heat-exchanger bottom width LWB are equal. As a result, the chilling unit 100C according to Embodiment 4 allows for greater freedom in, for example, the layout of devices forming the refrigerant circuit, or the routing of pipes than does the chilling unit 100L according to the comparative example. As described above, the chilling unit 100C according to Embodiment 4 has more space available inside the machine room unit 4 than does the chilling unit 100L according to the comparative example. The chilling unit 100C thus allows for greater ease of maintenance by the operator than does the chilling unit 100L according to the comparative example. Further, the chilling unit 100C according to Embodiment 4 thus allows the drain pan 55 to have enough area to install the heater 57. The chilling unit 100C according to Embodiment 2 also allows for greater stability in installation than does the chilling unit 100 according to Embodiment 1.

Embodiment 5

[Chilling Unit System 110]

Figure 12:
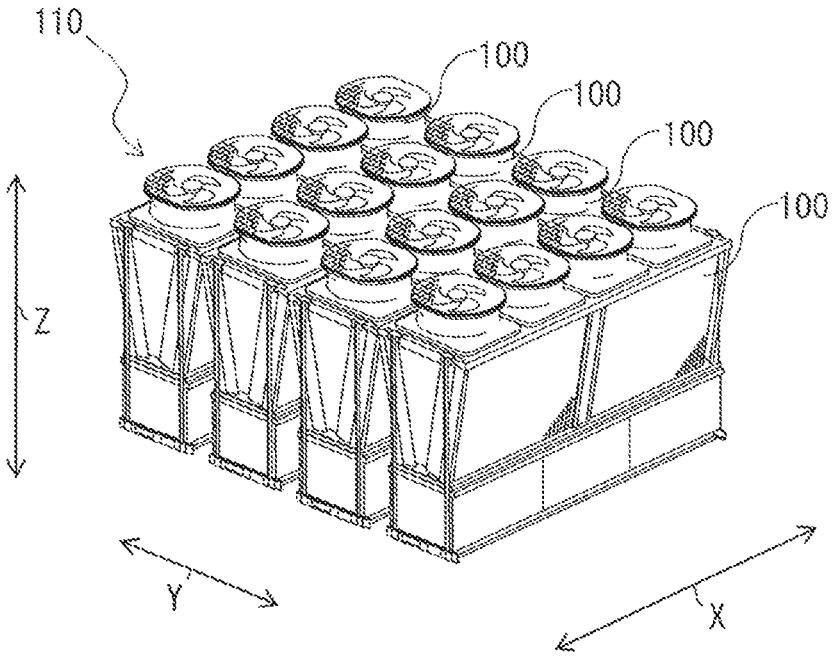
FIG. 12 is a perspective view of a chilling unit system according to Embodiment 5.
Figure 13:
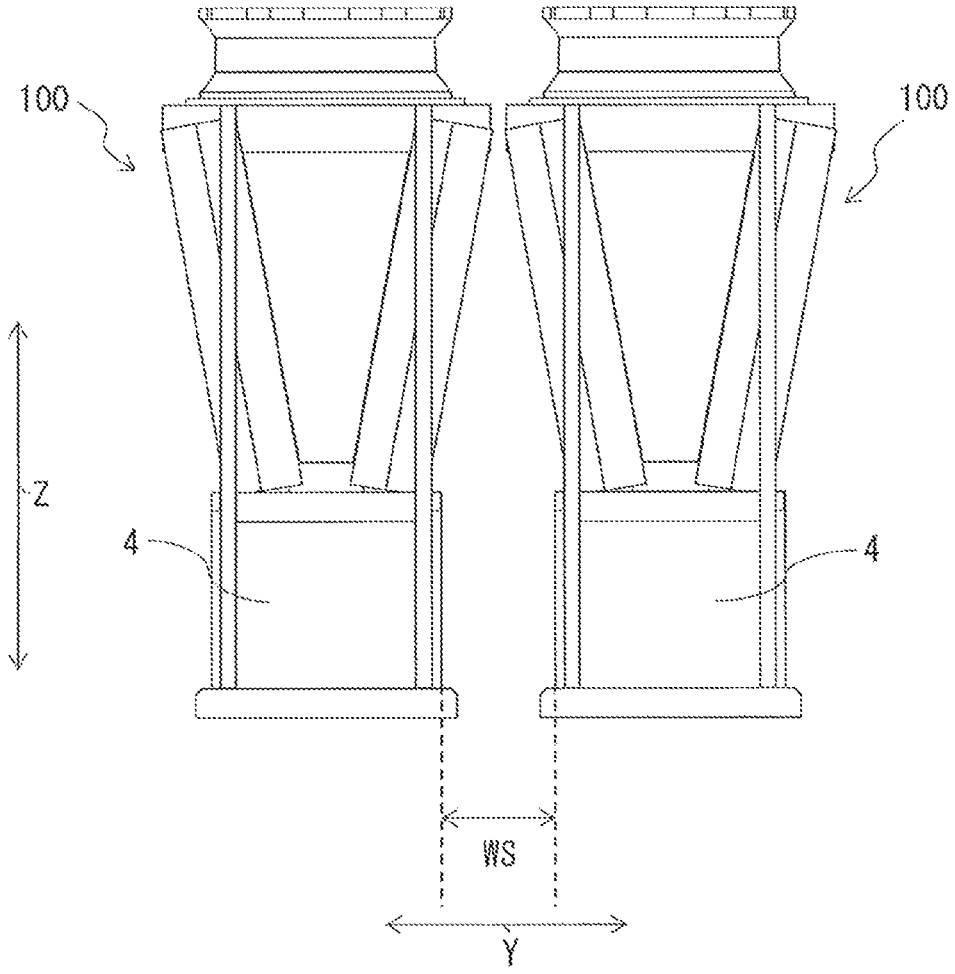
FIG. 13 conceptually illustrates the relationship between two adjacent chilling units that constitute the chilling unit system according to Embodiment 5.
Figure 14:
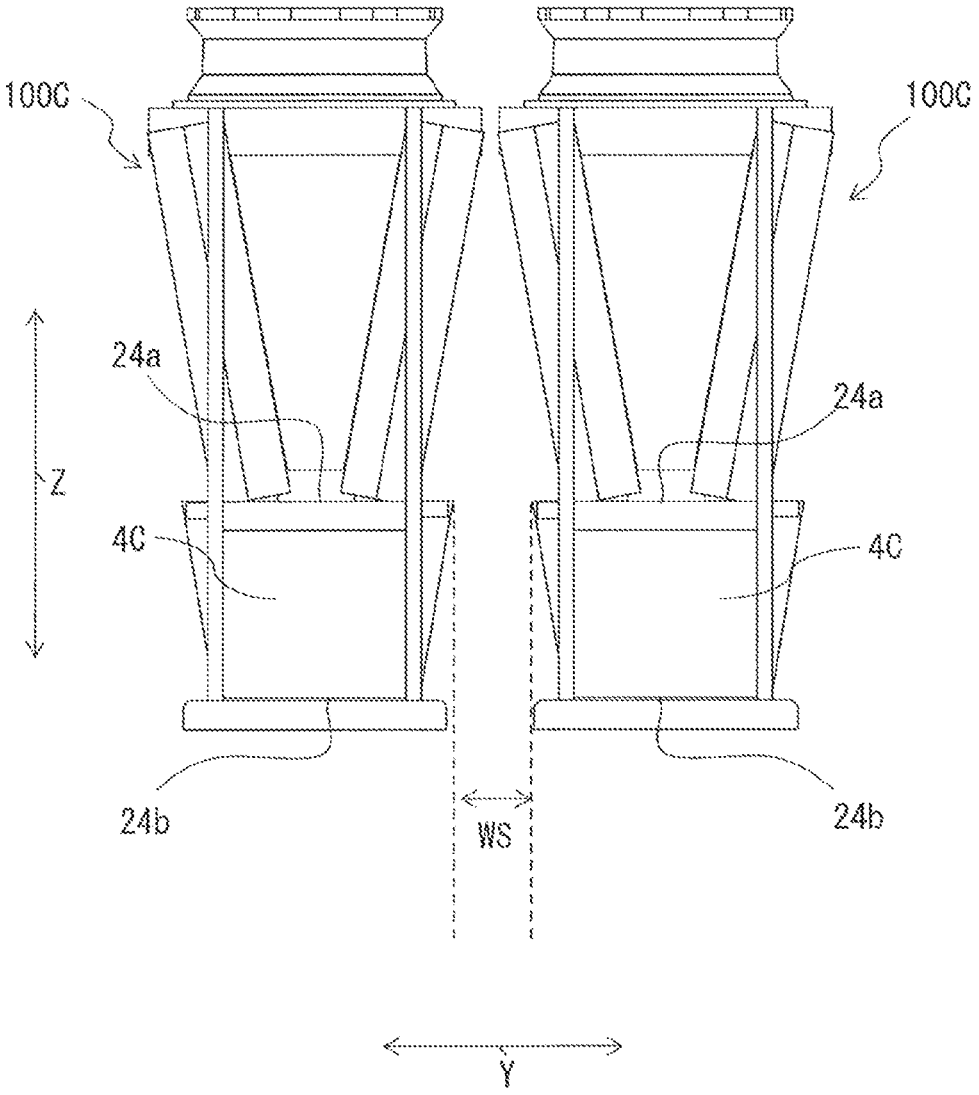
FIG. 14 conceptually illustrates the relationship between two adjacent chilling units that form the chilling unit system according to Embodiment 5.

FIG. 12 is a perspective view of a chilling unit system 110 according to Embodiment 5. FIG. 13 conceptually illustrates the relationship between two adjacent chilling units 100 that form the chilling unit system 110 according to Embodiment 5. FIG. 14 conceptually illustrates the relationship between two adjacent chilling units 100C that constitute the chilling unit system 110 according to Embodiment 5. Features configured in the same manner as those of the chilling unit 100 or other chilling units in FIGS. 1 to 11 are designated by the same reference signs and not described in further detail below.

As illustrated in FIG. 12, the chilling unit system 110 includes a plurality of chilling units 100. The chilling unit system 110 includes the chilling units 100 arranged side by side in the lateral direction (Y-axis direction) of the chilling units 100. In the chilling unit system 110, the chilling units 100 are disposed with their respective longitudinal directions (X-axis directions) parallel to each other. As illustrated in FIG. 13, in the lateral direction (Y-axis direction) of the chilling units 100, the respective machine room units 4 of two adjacent chilling units 100 of the chilling unit system 110 have a spacing WS between each other of greater than or equal to 400 mm.

As illustrated in FIG. 14, in the lateral direction (Y-axis direction) of the chilling units 100C, the respective machine room units 4 of two adjacent chilling units 100C of the chilling unit system 110 have a spacing WS between each other of greater than or equal to 400 mm. As described above, the top width WA1 of the chilling unit 100C is greater than the bottom width WA2. Accordingly, the spacing between the respective machine room units 4 of two adjacent chilling units 100C is defined as the spacing between the side walls of the respective top face portions 24*a* of the two adjacent chilling units 100C.

[Operational Effects of Chilling Unit System 110]

In the chilling unit system 110, in the lateral direction (Y-axis direction) of the chilling units 100, the respective machine room units 4 of two adjacent chilling units 100 have a spacing between each other of greater than or equal to 400 mm. The chilling unit system 110 according to Embodiment 5 thus allows for enough space at the operators feet. Since the chilling unit system 110 according to Embodiment 5 allows for enough space at the operators feet, it is possible for the operator to, for example, remove a screw attached to a panel to thereby remove the panel, and place a screw box at the feet to store the removed screw. As a result, in comparison to a chilling unit system including an arrangement of a plurality of chilling units 100L according to the comparative example, the chilling unit system 110 according to Embodiment 5 allows for increased freedom in, for example, the layout of devices forming the refrigerant circuit, or the routing of pipes, and also increased ease of maintenance by the operator.

The configurations presented in the foregoing description of the embodiments are intended to be illustrative only. These configurations can be combined with other known techniques, or can be partially omitted or changed without departing from the scope of the present disclosure.

REFERENCE SIGNS LIST

1: air heat exchanger, 1A: air heat exchanger, 1B: air heat exchanger, 1C: air heat exchanger, 1D: air heat exchanger, 3: heat exchanger, 4: machine room unit, 4A: machine room unit, 4B: machine room unit, 4C: machine room unit, 5: fan, 5A: fan, 5B: fan, 5C: fan, 5D: fan, 6A: bellmouth, 6B: bellmouth, 6C: bellmouth, 6D: bellmouth, 7: heat transfer tube, 8: fin, 10: base, 11*a*: upper end portion, 11*b*: lower end portion, 14: air outlet, 17: fan guard, 24*a*: top face portion, 24*b*: bottom face portion, 31: compressor, 32: control box, 33: flow switching device, 40: frame, 41: underframe, 42: gatepost, 42A: gatepost, 42A1: gatepost, 42B: gatepost, 42B1: gatepost, 42C: gatepost, 42C1: gatepost, 42D: gatepost, 42D1: gatepost, 43: intermediate post, 43A: intermediate post, 43A1: intermediate post, 43B: intermediate post, 43B1: intermediate post, 43C: intermediate post, 43C1: intermediate post, 43D: intermediate post, 43D1: intermediate post, 44: top beam, 45: side wall, 45*a*: first side wall, 45*b*: second side wall, 50: side panel, 51: side panel, 51*a*: upper edge portion, 51*b*: lower edge portion, 55: drain pan, 57: heater, 60: top frame, 70: support post, 100: chilling unit, 100A: chilling unit, 100B: chilling unit, 100C: chilling unit, 100L: chilling unit, 110: chilling unit system.

The invention claimed is:

1. A chilling unit comprising:

a machine room unit formed in a shape of an elongated box and configured to accommodate a compressor and a heat exchanger; and a plurality of air heat exchangers placed on top of the machine room unit, the plurality of air heat exchangers forming a refrigerant circuit together with the compressor and the heat exchanger, wherein the plurality of air heat exchangers include a pair of air heat exchangers, the pair of air heat exchangers including two air heat exchangers that are opposite to each other in a lateral direction of the machine room unit, and wherein the two air heat exchangers are inclined such that respective upper end portions of the two air heat exchangers remote from the machine room unit have a spacing between each other that is greater than a spacing between respective lower end portions of the two air heat exchangers proximate to the machine room unit, and wherein in the lateral direction, the machine room unit includes a base provided to a top of the machine room unit, the machine room unit having a top width at the base that is greater than a heat-exchanger bottom width, the top width being defined as a width between an outermost surface of side walls in a top face portion of the machine room unit, the heat-exchanger bottom width being defined as a width between an outermost surface of outer side faces of the respective lower end portions of the two air heat exchangers, and the top width and the heat-exchanger bottom width have a difference of less than or equal to 50 mm and configured and adapted to accommodate a heater disposed on an upper surface of the base outside the outermost surface of the outer side faces.

2. The chilling unit of claim 1, wherein in the lateral direction, the machine room unit has a bottom width and a height dimension, the bottom width being defined as a width between side walls in a bottom face portion of the machine room unit, the height dimension being defined as a dimension between the top face portion and the bottom face portion in a vertical direction perpendicular to a longitudinal direction of the machine room unit and to the lateral direction of the machine room unit, and wherein the machine room unit is formed in a cuboid shape, and the top width, the bottom width, and the height dimension of the machine room unit are equal.

3. The chilling unit of claim 1, wherein in the lateral direction, the machine room unit has a bottom width and a height dimension, the bottom width being defined as a width between side walls in a bottom face portion of the machine room unit, the height dimension being defined as a dimension between the top face portion and the bottom face portion in a vertical direction perpendicular to a longitudinal direction of the machine room unit and to the lateral direction of the machine room unit, and wherein the machine room unit is formed in a cuboid shape, the top width and the bottom width of the machine room unit are equal, and the top width and the bottom width of the machine room unit are greater than the height dimension of the machine room unit.

4. The chilling unit of claim 1, wherein in the lateral direction, the machine room unit has a bottom width and a height dimension, the bottom width being defined as a width between side walls in a bottom face portion of the machine room unit, the height dimension being defined as a dimension between the top face portion and the bottom face portion in a vertical direction perpendicular to a longitudinal direction of the machine room unit and to the lateral direction of the machine room unit, wherein the machine room unit has a trapezoidal shape in cross-section taken perpendicular to the longitudinal direction, and wherein the top width of the machine room unit is greater than the bottom width of the machine room unit, and the top width and the height dimension of the machine room unit are equal.

5. The chilling unit of claim 1, wherein in the lateral direction, the machine room unit has a bottom width and a height dimension, the bottom width being defined as a width between side walls in a bottom face portion of the machine room unit, the height dimension being defined as a dimension between the top face portion and the bottom face portion in a vertical direction perpendicular to a longitudinal direction of the machine room unit and to the lateral direction of the machine room unit, wherein the machine room unit has a trapezoidal shape in cross-section taken perpendicular to the longitudinal direction, and wherein the top width of the machine room unit is greater than the bottom width of the machine room unit, and the top width of the machine room unit is greater than the height dimension of the machine room unit.

6. The chilling unit of claim 1, further comprising:

a drain pan disposed below the plurality of air heat exchangers to catch droplets of water dripping down from the plurality of air heat exchangers; and a heater provided to the drain pan and extending along the lower end portions of the plurality of air heat exchangers.

7. A chilling unit system comprising a plurality of the chilling units of claim 1, wherein the plurality of chilling units include two adjacent chilling units, and in the lateral direction, the machine room units of the two adjacent chilling units have a spacing between each other of greater than or equal to 400 mm.

8. A chilling unit comprising:

a machine room unit formed in a shape of an elongated box and configured to accommodate a compressor and a heat exchanger; and a plurality of air heat exchangers placed on top of the machine room unit, the plurality of air heat exchangers forming a refrigerant circuit together with the compressor and the heat exchanger, wherein the plurality of air heat exchangers include a pair of air heat exchangers, the pair of air heat exchangers including two air heat exchangers that are opposite to each other in a lateral direction of the machine room unit, wherein the two air heat exchangers are inclined such that respective upper end portions of the two air heat exchangers remote from the machine room unit have a spacing between each other that is greater than a spacing between respective lower end portions of the two air heat exchangers proximate to the machine room unit, and wherein in the lateral direction, the machine room unit has a top width that is greater than a heat-exchanger bottom width, the top width being defined as a width between side walls in a top face portion of the machine room unit, the heat-exchanger bottom width being defined as a width between outer side faces of the respective lower end portions of the two air heat exchangers, wherein in the lateral direction, the machine room unit has a bottom width and a height dimension, the bottom width being defined as a width between side walls in a bottom face portion of the machine room unit, wherein the machine room unit has a trapezoidal shape in cross-section taken perpendicular to the longitudinal direction, and wherein the top width of the machine room unit is greater than the bottom width of the machine room unit.

9. The chilling unit of claim 8, wherein, when the height dimension is defined as a dimension between the top face portion and the bottom face portion of the machine room unit in a vertical direction perpendicular to the longitudinal direction and to the lateral direction, the top width and the height dimension of the machine room unit are equal.

10. The chilling unit of claim 8, wherein, when a height dimension is defined as a dimension between the top face portion and the bottom face portion in a vertical direction of the machine room unit perpendicular to the longitudinal direction and to the lateral direction, the top width of the machine room unit is greater than the height dimension of the machine room unit.

11. The chilling unit of claim 8, wherein the top width and the heat-exchanger bottom width have a difference of less than or equal to 50 mm.

12. The chilling unit of claim 8, further comprising:

a drain pan disposed below the plurality of air heat exchangers to catch droplets of water dripping down from the plurality of air heat exchangers; and a heater provided to the drain pan and extending along the lower end portions of the plurality of air heat exchangers.

13. A chilling unit system comprising a plurality of the chilling units of claim 9, wherein the plurality of chilling units include two adjacent chilling units, and in the lateral direction, the machine room units of the two adjacent chilling units have a spacing between each other of greater than or equal to 400 mm.

* * * * *